United States Patent [19]

Podszun et al.

[11] Patent Number: 4,521,505

[45] Date of Patent: Jun. 4, 1985

[54] ELECTROSTATOGRAPHIC SUSPENSION DEVELOPER AND PROCESS FOR THE PRODUCTION THEREOF

[75] Inventors: Wolfgang Podszun, Cologne; Walter Simm, Leverkusen; John Goossens, Cologne; Carlhans Süling, Odenthal, all of Fed. Rep. of Germany

[73] Assignee: Agfa-Gevaert Aktiengesellschaft, Leverkusen, Fed. Rep. of Germany

[21] Appl. No.: 525,625

[22] Filed: Aug. 23, 1983

[30] Foreign Application Priority Data

Aug. 28, 1982 [DE] Fed. Rep. of Germany ..... 3232062

[51] Int. Cl.[3] ..... G03G 9/12

[52] U.S. Cl. ..... 430/112; 430/114; 430/115; 430/137

[58] Field of Search ..... 430/112, 114, 115, 137

[56] References Cited

U.S. PATENT DOCUMENTS

| | | | |
|---|---|---|---|
| 3,668,127 | 6/1972 | Machida et al. | 252/62.1 |
| 4,014,856 | 3/1977 | Gilliams et al. | 430/115 |
| 4,334,013 | 6/1982 | Bergthaller | 430/627 |

*Primary Examiner*—John E. Kittle
*Assistant Examiner*—John L. Goodrow
*Attorney, Agent, or Firm*—Connolly and Hutz

[57] ABSTRACT

The suspension developer contains as a toner polymer-sheathed pigment particles in an electrically insulating carrier liquid. The sheath of the pigment particles is formed by precipitation polymerization from various (meth)acrylates, a cross-linker and, optionally, a vinyl or vinylidene monomer. The developer has an outstanding dispersion stability which does not change during use or storage.

16 Claims, No Drawings

ELECTROSTATOGRAPHIC SUSPENSION DEVELOPER AND PROCESS FOR THE PRODUCTION THEREOF

This invention relates to an electrostatographic suspension developer based on pigment particles sheathed with cross-linked precipitation polymer and to a process for the production of the developer.

Wet and dry developing processes are known for the development of electrostatic images on electrostatographic recording materials. Wet developing processes are superior to dry developing processes with respect to marginal definition and resolution, particularly in the case of color copy processes.

Known electrostatographic suspension developers are generally produced by dispersing pigment particles in a highly insulating carrier liquid, together with a soluble polymer and a charge-determining substance, also termed a control substance. In this process, the polymer is absorbed by the pigment particles, a so-called toner being produced, imparting a certain stability to the resulting pigment dispersion (usually termed a toner dispersion). Liquid developers of this type have been widely used in electrostatographic processes. However, they have a number of disadvantages.

One particular disadvantage is the presence of non-absorbed polymer in the carrier liquid, the quantity of which is increased if, during the use of the toner dispersion to develop the image, the consumed toner is replaced by the addition of developer concentrate. The concentraton of the dissolved polymer then results in changes in the electrostatographic properties of the developer and thus leads to an impairment of the quality. This disadvantage is tied to the existing adsorption-desorption equilibrium and is thus unavoidable when soluble polymer is used.

Attempts have been made to achieve a firm anchoring of the polymer to the pigment surface by chemical bonds. Thus, DE-A No. 2,157,143 discloses a process for the production of an electrostatographic suspension developer by the graft polymerisation of acrylinester monomers onto a pigment. However, graft polymerisation reactions have the disadvantage that a "conventional" homo- or co-polymerisation also takes place in addition to the graft polymerisation and, in this way, in addition to the desired graft product, homo- or co-polymer is also formed which is not anchored to the pigment. Expensive separating processes are necessary to purify the graft product. Another difficulty resides in that the graft yield depends to a considerable extent on the type of graft substrate, which complicates the preparation of similar, differently coloured suspension developers for colour copy processes.

DE-B No. 1,933,362 describes the shell-like coating of pigments with polymers. In this process, an internal insoluble polmer sheath and an external sheath which may be swollen in the carrier liquid are applied to the pigment. The polymers which are used are non-cross-linked. They are produced in the absence of the pigment by mass polymerisation and are applied to the pigment as a solution (for example in toluene) or as a melt. The particle size is adjusted by grinding in a ball mill. A disadvantage of this process is that relatively coarse toner particles (about 0.99 mm) are obtained which restricts the resolution.

DE-A No. 2,026,390 discloses the production of toner particles by the polymerisation of synthetic resin monomers and dyeing materials by suspension polymerisation The polymer particles obtained in this process are primarily suitable for use as dry developers due to the particle size and to other properties thereof.

GB-A No. 868,974 describes a liquid electrostatographic developer containing toner particles which have been coated with a polymer of an arcylate or a methacrylate of hydrogenated abietyl alcohol. The polymer is produced separately or is synthetized in the presence of the pigment by a mass polymerisation process. The particles size spectrum of the developer is relatively broad, which is a disturbing factor in the reproduction of the tone values.

An object of the present invention is to provide an electrostatographic suspension developer which contains finely-divided, polymer-sheathed pigment particles, which has an improved storage stability and which may be advantageously used for color copy processes.

This object is achieved according to the present invention by an electrostatographic suspension developer which suspends, as a toner, polymer-sheathed pigment particles in an electrically insulating carrier liquid having a volume resistance of at least $10^9$ Ohm·cm and a dielectric constant of less than 3, and optionally contains a dissolved control substance, and is characterised in that the toner has a particle size of from 0.2 to 2 $\mu$m and has a sheath of a cross-linked precipitation polymer which is formed from:

(A) at least 25 parts by weight, of a (meth)acrylate having from 8 to 24 carbon atoms in the alcohol moiety, (B) from 2 to 50 parts, by weight, of a cross-linker (C) from 2 to 50 parts, by weight, of a (meth)acrylate having from 1 to 7 carbon atoms in the alcohol moiety, and (D) from 0 to 25 parts, by weight, of a vinyl or vinylidene monomer which may be copolymerised with (A) and (C) and is different from (A) and (C), the total of the weight quantities amounting to 100 in each case; and in that from 25 to 90%, by weight, of the toner consists of the cross-linked precipitation polymer.

The present invention also provides a process for the production of an electrostatographic suspension developer by precipitation polymerisation in a carrier liquid as defined above in the presence of the pigment.

The precipitation polymer which is formed according to the present invention is firmly anchored on the pigment surface and has a fine structure typical of precipitation polymers which may be visualized by, for example, scanning electron microscopic recordings.

The present suspension developers have an outstanding dispersion stability which does not change during use or storage.

The process for the production of the suspension developers according to the present invention has the advantage over hitherto conventional processes involving the following separate operations: polymer production, pigment sheathing, grinding and dispersion in that they are reduced in number and are combined into a single operation.

The production of the suspension developers according to the present invention proceeds from a pigment dispersion in an electrically insulating liquid which is suitable as a carrier liquid. Pigments which are used in conventional electrostatographic suspension developers are suitable as the pigment particles. The following pigments are included as examples thereof: azo dyes, xanthene dyes, phthalocyanine dyes of the type described in DE-A No. 2,944,021, inter alia triphenyl methane dyes, acridine dyes, quinoline dyes, quinonimine dyes, thiazine dyes or azine dyes. The following for example are particularly suitable: spirit black (C.I. No. 50415), aniline black (C.I. No. 50440), cyanine blue (C.I. No. 74250), Brillant Carmine 6 B (C.I. 15850), fast red (C.I. 15865), benzidine orange (C.I. No. 21110) or permanent yellow GR 52 (C.I. 21100). The following are particularly preferred: carbon black (C.I. No. 77266), helio fast blue (HG (C.I. No. 74160), Fanalrosa B (C.I. No. 45160) and helio fast yellow GRN (C.I. No. 21100).

Electrically insulating liquids which have a volume resistance of at least $10^9$ Ohm·cm and a dielectric constant of less than 3, preferably based on hydrocarbon, are used as the liquid component or the carrier liquid for the pigment dispersion, for example aromatic hydrocarbons, such as benzene, toluene or xylenes, or aliphatic $C_6$–$C_{15}$ hydrocarbons, such as n-hexane, cyclohexane, n-heptane, n-octane or decalin. Mixtures of different hydrocarbons may also be used. Branched aliphatic hydrocarbons, such as isodecane and isododecane, are particularly suitable.

The weight quantity of the pigment should be from 0.5 to 50%, preferably from 5 to 30%, based on the pigment dispersion.

The pigment dispersion may be used without stabilization additives. However, it is preferred in many cases to pre-stabilize the dispersion by small additions (from 0.05 to 15%, by weight, based on the amount of pigment) of a soluble polymer. For this purpose, homo- or co-polymers of (meth)acrylates, for example a 1:1 copolymer of isobutyl methacrylate and lauryl methacrylate, are suitable. The following are also particularly suitable: copolymers having from 0.1 to 10%, by weight, of copolymerised monomers having —OH, —COOH, —$NH_2$, —NHR, or —$NR_2$ groups, for example 2-hydroxy-ethyl methacrylate, (meth)acrylic acid, (meth)acrylamide, N,N-dimethyl-acrylamide, N,N-dimethylaminoethyl methacrylate and N-vinyl pyrrolidone. The preferred molecular weight range is from 50,000 to 250,000.

The esters of acrylic acid or methacrylic acid and straight- and branched-chain $C_8$–$C_{24}$ alkanes are to be understood as (meth)acrylates (A) having from 8 to 24 carbon atoms in the alcohol moiety. The following are mentioned as examples: 2-ethylhexyl methacrylate, decyl methacrylate, dodecyl methacrylate, lauryl methacrylate and stearyl methacrylate.

The following, for example, are suitable as cross-linkers (B): polyfunctional (meth)acrylates, such as ethylene di(meth)acrylate, ethylene glycol-di(meth)acrylate, diethylene glycol di(meth) acrylate, glycerine trimethacrylate, and trimethylolpropane trimethacrylate, but also divinyl benzene and allyl methacrylate.

In principle, (meth)acrylates having from 1 to 7 carbon atoms in the alcohol moiety are suitable as component (C). The following are included as examples of suitable components (D): hydroxy- and (optionally N-alkyl substituted) amino alkyl methacrylates, such as 2-hydroxyethyl methacrylate or N,N-dimethylaminoethyl methacrylate, also styrene, vinyl toluene, α-methylstyrene, maleic acid anhydride, vinyl acetate, allyl alcohol and vinyl pyrrolidone.

Particularly good results are obtained from the use of toners which contain from 1 to 15 parts, by weight, of component (D).

The ratio of pigment to total quantity of monomers (total of (A), (B), (C) and (D)) should be from 3:1 to 1:10, preferably from 2:1 to 1:5.

Conventional radical formers, in particular peroxides and azo compounds are suitable as starting components for the production of the toners of present suspension developers. The following are mentioned as examples: aliphatic azodi-carboxylic acid derivatives, such as azobisisobutyric acid nitrile or azodicarboxylic acid esters, peroxides, such as lauroyl peroxide, succinyl peroxide, dibenzoyl peroxide, p-chlorobenzoyl peroxide, ketoneperoxides, such as methylethyl ketone peroxide, methylisobutyl ketone peroxide, cyclohexanone peroxide, alkyl esters of per-acids, such as t-butyl perpivalate, t-butyl peroctoate, t-butyl perbenzoate, mono-t-butyl permalinate, percarbonates, such as dicyclohexyl- and diisopropyl percarbonate, dialkyl peroxides, such as di-t-butyl peroxide, dicumyl peroxide and hydro-peroxides, such as t-butyl- or cumene hydroperoxides. From 0l.1 to 10%, by weight, preferably from 1 to 5%, by weight, of starting component, based on the monomers (A) to (D), are generally used.

A combination of different starting components, for example starting components having different decomposition temperatures may also be advantageously used in many cases.

The use of mono-polymerisable radical-starters is favourable if the release of decomposition products of the starter into the liquid phase is to be prevented. Suitable starting components of this type include, for example dimethacryloyl peroxide and p, p'-divinylbenzoyl peroixde (U.S. Pat. No. 2,593,399).

The reaction temperature depends on the type of starting component which is used and it generally ranges from 50° to 150° C. The polymerisation reaction may be carried out under normal pressure or under elevated pressure. The use of a vacuum may be advisable as the degassing stage at the end of the reaction.

The precipitation polymerisation reaction may be carried out according to a "batch process". In this case, the monomers and the starting component are added at once to the pigment dispersion and the reaction is initiated by increasing the temperature. In this manner, pigment particles are obtained which have a substantially uniform polymer sheath.

In a preferred embodiment, the monomers and the starting components are metered in during polymerisation. This embodiment provides a number of possibilities which are particularly advantageous in commercial terms. Thus, for example, it is possible to change the monomer composition over the metering period and, in this manner, to build up a shell-like polymer sheath. It is possible, and in certain cases advisable, initially to adjust a high quantity of cross-linker and then to lower it during the metering period. Accordingly, a slightly cross-linked external sheath is obtained which may be swollen to a greater extent compared to the internal sheath. Pigment particles which are built up in this manner are distinguished by a high dispersion stability.

To achieve high stabilities, it is also preferred to meter in the monomers (D), in particular if (D) contains polar groups, such as —OH, —$NH_2$ or —COOH, preferably at the beginning of polymerisation and thus to polymerise these monomers into the vicinity of the pigment surface.

The starting component is advantageously also metered in over the reaction period. Solid starting components are appropriately dissolved in solvents or monomers.

The pigment dispersion is mixed throughout the complete reaction by shaking or stirring, and the use of ultrasound is also an effective method. Pigment dispersions in particular which have not been previously stabilized with soluble polymer have to be dispersed at the beginning of the reaction by sufficiently high shearing forces. An increasing stabilization occurs during the reaction, caused by the polymer which has formed, so that the mixing energy which is being applied may be reduced.

It is advantageous to achieve as complete a reaction as possible in the polymerisation reaction in order to rule out an impairment to the operability of the suspension developer by unreacted monomers. Thus, the conversion should amount to at least 80%. It may be influenced in a known manner by the reaction time, the reaction temperature and the concentration of starting component.

The sheathed polymer particles have an average particle size of from 0.2 to 2/μm. The dispersion which is obtained according to the present process by precipitation polymerisation may be diluted to the desired working concentration, for example to from 0.01 to 1%, by adding more carrier liquid. In this event, the present carrier liquid may be exchanged for another, if desired.

Known control substances may be used to regulate the electrical charge of the toner particles in the present suspension developers. These substances include, for example oil-soluble ionogenic compounds, for example metal salts of long-chain organic acids. Mixtures of different control substances, for example a mixture of different control substances having opposite charge effects, may also be used, so that the strength of the charge on the toner or the polarity thereof may be adjuted by changing the mixture ratio of the two control substances (GB-A Nos. 1,411,287; 1,411,537 and 1,411,739). Positively acting control substances which are particularly suitable are described in GB-A No. 1,151,141. These control substances are di- or tri-valent metal salts of phosphorus oxyacid and containing an organic radical, in particular salts of the metals zinc, copper, cadmium, aluminium or iron of (a) a mono- or di-ester of phosphorus oxyacid;
(b) a phosphorus oxyacid which contains one or two organic groups bound by a carbon atom to the phosphorus; or
(c) a phosphorus oxyacid which contains one ester group and an organic group bound to the phosphorus by a carbon atom, and this organic group is aliphatic, cycloaliphatic or aromatic.

The organic group preferably contains a chain of at least 4 carbon atoms, in particular from 10 to 18 carbon atoms, and it may also be substituted and/or interrupted by one or more heteroatoms, for example by oxygen, sulfur or nitrogen.

Particularly good results are obtained using zinc salts. However, other salts may also be used, for example magnesium, calcium, strontium, barium, iron, cobalt, nickel, copper, cadmium, aluminium and lead salts.

The solubility of the described metal salts in the electrically insulating carrier liquid may be furthered by one or more organic groups of a branched structure, for example by branched aliphatic groups, such as a 2-butyloctyl group.

Other suitable positively acting charge control agents contain a metal alkyl sulfonate, which contains the metal ion or one of the divalent metal ions zinc (II), lead (II), cadmium (II) or copper (II) or a trivalent metal ion from Group VII of the Periodic Table of Elements, for example iron (III), or from Group VIB, for example chromium (III), and in which the sulphonate group is directly linked to a straight alkyl chain having at least 6 carbon atoms.

The control substance is either added to the concentrate of the suspension developer, or is added when the developer is diluted to the required working concentration. The most favourable quantity may be easily determined by simple experiments.

Zinc -mono(2-butyl)-octylphosphate is preferred as a control substance.

Although the suspension developer according to the present invention already has an adequate adhesiveness, so-called fixing agents may be incorporated in the finished developer for particular uses of the suspension pension developers, for example for developing charge images on electo-photographic binder layers. Resins are suitable as fixing substances. They have to be compatible with the binding material of the photoconductive recording material, for example with the binding agent of a photoconductive zinc oxide layer, so that a good adhesion of the resulting image is obtained on the support after development. Examples of suitable resins include esters of hydrogenated colophony and long-oil oil lacquer, colophony -modified phenol formaldehyde resin, pentaerythritol ester of colophony, glycerine ester of hydrogenated colophony, ethyl cellulose, different alkyd resins, polyacryl- and polymethacryl resins, polystyrene, polyketone resins and polyvinylacetate. Specific examples of such resins may be found in the literature relating to electrostatographic suspension developers, for example in BE-A No. 699,157 and in GB-A No. 1,151,141.

The sheathing of pigment particles in a carrier liquid by precipitation polymerisation and the production of suspension developers acccording to the present invention will be described in detail in the following Examples.

EXAMPLE 1

A pigment dispersion, produced using a ball mill from 30 g of helio fact yellow GRN (C.I. 21,100), 270 g of isododecane and 0.3 g of polylauryl methacrylate (MW 150,000) was introduced into a 1 liter pot provided with a blade stirrer, a reflux condenser, a dropping funnel and gas inlet and outlet pipes, and was heated to 80° C. The dispersion was purged with $N_2$, stirred at 500 r.p.m. and mixed with 0.5 g of azoisobutyric acid dinitrile (AIBN).

The following were then dissolved in 34 ml of isododecane:

3 g of N,N-dimethylaminoethyl methacrylate,
6 g of ethylene dimethacrylate,
3 g of dodecyl methacrylate and
3 g of tetradecyl methyacrylate, and where continuously introduced into the dispersion over a period of one hour at a constant dropping rate. Then, a further 0.5 g of AIBN were added, and the following were added dropwise over a period of one hour:

3 g of ethylene dimethacrylate
6 g of dodecyl methacrylate, and
6 g of tetracdecyl methacrylate, dissolved in
34 g of isododecane.

After the addition, the mixture was subsequently stirred for one hour at 80° C., and then for another hour at 90° C.

A stable dispersion was produced. Before this dispersion was used as a developer in a known type of electrostatographic device, it was diluted with isododecane to a solids content of 4%, by weight, and was mixed with 12 mg of zinc-mono-(2-butyl)-octylphosphate per gram of solids. The charge of the toner particles was stabilized after storing for 24 hours. The particle size was from 0.8 to 1.2 μm.

EXAMPLE 2

A dispersion of 35 g of helio fast blue HG (C.I. 74160) and 315 g of isododecane was introduced into the apparatus described in Example 1. The following were continuously added to the dispersion over a period of 60 minutes at 60° C., with stirring at 600 r.p.m.:

34.3 g of decyl methacrylate,
28 g of isobutyl methacrylate,
7 g of ethylene dimethacrylate, and
1.75 g of cyclohexyl percarbonate.

The temperature was then maintained at 70° C. for one hour and the mixture was subsequently stirred for 2 hours at 80° C. after adding 0.88 g of dibenzoyl peroxide. A stable dispersion was produced.

After diluting the dispersion to a solids content of 4%, by weight, 6 mg of zinc-mono-(2-butyl)-octylphosphate per gram of solids were added. After 24 hours, the developer was ready for use. The particle size was 0.86 μm. The suspension developer exhibited a very good storage stability. The particle size was unchanged even after a storage time of 6 months.

EXAMPLE 3

A dispersion produced from 30 g of Fanalrosa B (C.I. No. 45160), 1.5 g of copolymer of isobutyl methacrylate and lauryl methacrylate (1:1) and 268.5 g of isododecane was introduced into the apparatus described in Example 1. A mixture consisting of:

15 g dodecyl methacrylate,
9 g of ethylene dimethacrylate,
3 g of isobutyl methacrylate,
3 g of 2-hydroxypropyl methacrylate,
1 g of dibenzoyl peroxide and
1 g of cyclohexyl percarbonate was then added to the dispersion at 60° C. with stirring at 500 r.p.m. over a period of 80 minutes at a constant dropping rate. The temperature was then increased to 65° C., and a mixture consisting of:

15 g of dodecyl methacrylate
3 g of ethylene dimethacrylate,
9 g of isobutyl methacrylate,
0.5 g of dibenzoyl peroxide and
0.5 g of cyclohexyl percarbonate was added over a period of 60 minutes at a constant dropping rate. After the addition, the temperature was maintained at 75° C. for 90 minutes and 85° C. for a further 90 minutes.

A stable dispersion was produced (particle size about 0.6 μm). After diluting with isododecane and after adding zinc-mono-(2-butyl)-octyl-phosphate, a suspension developer having good developer properties and an outstanding storage stbility was obtained.

EXAMPLE 4

(Comparative Example)

50 g of the oleyl ester of methacrylic acid 50 g of finely ground helio fast yellow GRN (C.I. 21100) and 1 g of azobisisobutyronitrile in benzene were reacted according to the graft polymerisation process described in Example 1 of DE-OS No. 2,157,143. The reaction product was freed from soluble constituents by repeatedly pouring into methanol and was dispersed in the isoparaffin solvents stated in the above-mentioned DE-A.

The stability of the resulting dispersion was inadequate for practical use. The toner particles tend towards agglomeration and sedimentation.

The developer produces unclean images by toner deposition in the image free areas.

EXAMPLE 5

(Comparative Example)

Helio fast blue HG (C.I. 74160) was covered with two plastic layers according to Example 1 of DE-B No. 1,933,362. The resulting granulates were crushed in a ball mill to a particle size of 0.09 mm and were dispersed in isododecane.

The resulting suspension was indeed suitable in principle for the development of latent elecrostatic images, but the resolution of the images obtained with the developer was deficient and unsatisfactory, particularly for the reproduction of colour images.

We claim:

1. An elecrostatographic suspension developer which suspends, as a toner, polymer-sheathed pigment particles in an electrically insulating carrier liquid having a volume resistance of at least $10^9$ Ohm·cm and a dielectric constant of less than 3, and which optionally contains a dissolved control substance, characterised in that the toner has a particle size of from 0.2 to 2 μm and has a sheath consisting of cross-linked precipitation polymer which is formed from:

(A) at least 25 parts, by weight, of a (meth)acrylate having from 8 to 24 carbon atoms in the alcohol moiety,
(B) from 2 to 50 parts, by weight, of a cross-linker,
(C) from 2 to 50 parts, by weight, of a (meth)acrylate having from 1 to 7 carbon atoms in the alcohol moiety; and
(D) from 0 to 25 parts, by weight, of vinyl or vinylidene monomer which may be copolymerised with (A) and (C) and is different from (A) and (C), the total of the weight quantities being 100 in each case, and in that from 25 to 90%, by weight, of the toner consists of the cross-linked precipitation polymer.

2. A suspension developer according to claim 1, characterised in that the sheath of the toner comprises at least two layers of a different chemical composition.

3. A suspension developer according to claim 1, characterised in that the sheath of the toner comprises a comparatively highly cross-linked internal layer and a less-cross linked external layer.

4. A suspension developer according to claim 1, characterised in that the sheath of the toner comprises a cross-linked precipitation polymer formed from:

(A) dodecyl methacrylate,
(B) ethylene glycol dimethacrylate
(C) isobutyl methacrylate, and (D) one or more monomers selected from hydroxyalkyl methacrylates and aminoalkyl methacrylates, including the N-alkylsubstituted aminoalkyl methacrylates.

5. A suspension developer according to one of claims 1 to 4, characterised in that the carrier liquid is isododecane.

6. A suspension developer according to one of claims 1 to 5, characterised in that a di- or tri-valent metal salt of a phosphorus oxyacid and contains an organic radical is contained as the change control substance.

7. A suspension developer according to claim 6, characterised in that the change control substance is zinc-mono(2-butyl)-octyl phosphate.

8. A process for the production of an electrostatographic suspension developer according to claim 1, characterised in that a monomer mixture consisting of:

(A) at least 25 parts, by weight, of a (meth)acrylate having from 8 to 24 carbon atoms in the alcohol moiety, (B) from 2 to 50 parts, by weight, of a cross-linker, (C) from 2 to 50 parts, by weight, of a (meth)acrylate having from 1 to 7 carbon atoms in the alcohol moiety, and (D) from 0 to 24 parts, by weight, of a vinyl or vinylidene monomer which may be copolymerised with (A) and (C) and is different from (A) and (C), the total of the weight quantities being 100 in each case, is added to a from 0.5 to 50%, by weight, dispersion which optionally contains a stabilizing agent, of a pigment in an electrically insulating carrier liquid having a volume resistance of at least $10^9$ Ohm-cm and a dielectric constant of less than 3, and precipitation polymerisation is initiated at a temperature of from 50° to 150° C. using a radical former as the starting component, the polymerisation being carried out with continuous mixing to a conversion of at least 80%, and the resulting dispersion being diluted by adding the same or a different carrier liquid to the suspension developer which is ready for use.

9. A process according to claim 8, characterised in that a dispersion of a pigment is used which contains as a stabilizing agent from 0.05 to 15%, by weight, based on the quantity of pigment, of a soluble homo- or copolymer based on methacrylates having a molecular weight of from 50,000 to 250,000.

10. A process according to claims 8 or 9, characterised in that the monomers (A) and (D) are continuously added to the dispersion separately or as a mixture.

11. A process according to claims 8 or 9, characterised in that the monomers (A) to (D) are continuously added to the dispersion and the quantity ratio of the monomers changes during the addition.

12. A process according to claim 8, characterised in that the quantity of monomer (B) is reduced during the addition of monomers (A) to (D).

13. A process according to claim 8, characterised in that the quantity of monomer (D) is reduced during the addition of monomers (A) to (D).

14. A process according to claim 8, characterised in that isododecane is used as the electrically insulating carrier liquid.

15. A process according to claim 8, characterised in that a change control substance which regulates the charge of the dispersed particles is added to the dispersion at the end of polymerisation.

16. A process according to claim 15, characterised in that the control substance is zinc-mono(2-butyl)-octyl phosphate.

* * * * *